US009593681B2

(12) United States Patent
Böhm

(10) Patent No.: US 9,593,681 B2
(45) Date of Patent: Mar. 14, 2017

(54) PUMP DEVICE FOR DELIVERING A MEDIUM

(71) Applicant: Christian Böhm, Frankfurt am Main (DE)

(72) Inventor: Christian Böhm, Frankfurt am Main (DE)

(73) Assignee: Contintental Automotive GmbH, Hannover (DE)

( * ) Notice: Subject to any disclaimer, the term of this patent is extended or adjusted under 35 U.S.C. 154(b) by 336 days.

(21) Appl. No.: 14/356,077

(22) PCT Filed: Oct. 22, 2012

(86) PCT No.: PCT/EP2012/070839
§ 371 (c)(1),
(2) Date: May 2, 2014

(87) PCT Pub. No.: WO2013/064386
PCT Pub. Date: May 10, 2013

(65) Prior Publication Data

US 2014/0301877 A1 Oct. 9, 2014

(30) Foreign Application Priority Data

Nov. 4, 2011 (DE) ..... 10 2011 085 795

(51) Int. Cl.

| | |
|---|---|
| ***F04C 2/344*** | (2006.01) |
| ***F04C 14/06*** | (2006.01) |
| ***F04C 11/00*** | (2006.01) |
| ***F01C 21/08*** | (2006.01) |
| *F04C 2/10* | (2006.01) |

(52) U.S. Cl.
CPC ..... *F04C 2/3446* (2013.01); *F01C 21/0863* (2013.01); *F04C 11/006* (2013.01); *F04C 14/06* (2013.01); *F04C 2/10* (2013.01)

(58) Field of Classification Search
CPC ..... F01C 21/0863; F04C 14/06
See application file for complete search history.

(56) References Cited

U.S. PATENT DOCUMENTS

| | | | | |
|---|---|---|---|---|
| 4,543,049 A * | 9/1985 | Shibuya | F01C 21/0863 418/269 |
| 5,147,183 A | 9/1992 | Gettel | |
| 5,188,522 A * | 2/1993 | Hara | F01C 21/0863 418/212 |

(Continued)

FOREIGN PATENT DOCUMENTS

| | | |
|---|---|---|
| CN | 101080572 | 11/2007 |
| CN | 201448235 | 5/2010 |

(Continued)

OTHER PUBLICATIONS

Machine translation of German Patent Publication DE 19952167, translated on May 27, 2016.*

*Primary Examiner* — Mary A Davis
(74) *Attorney, Agent, or Firm* — Cozen O'Connor

(57) ABSTRACT

A pump device having a vane-type pump has a check valve in a fluid duct which leads from a pressure region to an under-vane region. The check valve blocks in the direction of the pressure region, preventing pressure from escaping from the under-vane region into the pressure region during the start-up of the vane-type pump.

7 Claims, 2 Drawing Sheets

(56) References Cited

U.S. PATENT DOCUMENTS

| | | | | |
|---|---|---|---|---|
| 6,579,070 | B1 * | 6/2003 | Birkenmaier ..... | F01C 21/0863 417/216 |
| 8,419,392 | B2 | 4/2013 | Yamamuro et al. | |
| 2002/0037222 | A1 | 3/2002 | Dalton | |

FOREIGN PATENT DOCUMENTS

| | | | |
|---|---|---|---|
| DE | 25 12 433 | A1 | 9/1976 |
| DE | 26 30 736 | A1 | 3/1977 |
| DE | 28 35 816 | A1 | 2/1980 |
| DE | 196 31 846 | A1 | 2/1997 |
| DE | 199 52 167 | A1 | 6/2000 |
| DE | 10 2006 036 7 | | 2/2008 |
| DE | 10 2008 012 309 | A1 | 9/2008 |
| WO | WO 03/044368 | A1 | 5/2003 |
| WO | WO 2009/121470 | A1 | 10/2009 |

* cited by examiner

PUMP DEVICE FOR DELIVERING A MEDIUM

CROSS-REFERENCE TO RELATED APPLICATIONS

This is a U.S. national stage of application No. PCT/EP2012/070839, filed on 22 Oct. 2012, which claims priority to the German Application No. 10 2011 085 795.8, filed 4 Nov. 2011, the content of both incorporated herein by reference.

BACKGROUND OF THE INVENTION

1. Field of the Invention

The invention relates to a pump device for delivering a medium, having a vane-type pump, in which the vane-type pump has a rotor having vanes, which can be extended radially outward out of vane slots in the direction of a cam contour of a stator, and having under-vane regions, which are connected to a pressure region of the pump device by a fluid duct, to enable the under-vane regions to be subjected to pressure to hydraulically extend the vanes, wherein the under-vane regions of the vanes are connected to one another.

2. Related Art

Pump devices of this kind are used in modern motor vehicles to deliver transmission oil and are known in practice. In such a pump device, the under-vane regions are initially connected to one another. During a rotation of the rotor, some of the vanes are pressed into the rotor by the cam contour of the stator and produce a pressure in the under-vane region. Other vanes are supposed to be extended out of the rotor against the cam contour of the stator by the pressure in the under-vane regions. In order to ensure a sufficient pressure in the under-vane regions, the under-vane regions are furthermore connected to another pressure region by the fluid duct.

However, the disadvantage with the known pump device is that, where the medium is viscous or the vane-type pump is not completely filled with medium, the pressure produced in the under-vane regions by the retracted vanes can escape via the fluid duct. This has the effect that the vanes to be extended remain within the rotor and there is no delivery.

An object of the invention is to develop a pump device of the type stated at the outset in such a way that it allows a reliable pressure buildup as the vane-type pump starts.

According to an aspect of the invention, this problem is solved by virtue of the fact that the fluid duct is closed from the under-vane region in the direction of the pressure region, at least during the starting of the vane-type pump.

This configuration ensures that the pressure produced in the under-vane regions by the retracting vanes is used to extend other vanes. Since the fluid duct is closed during the starting of the vane-type pump, the situation in which pressure built up by the retracting vanes can escape into the pressure region before a pressure is built up in the pressure region is avoided. By virtue of this aspect of the invention, the vanes moved past the suction region are extended during the first revolution of the rotor. As a result, the pump device according to the invention is of particularly simple construction.

The fluid duct can be closed in both directions in accordance with the operating state of the pump device according to an aspect of the invention if a switchable valve is arranged in the fluid duct.

According to an advantageous aspect of the invention, the structural complexity involved in closing the fluid duct can be kept to a particularly low level if a check valve is arranged in the fluid duct, and if the check valve shuts off in the direction of the pressure region. During the starting of the vane-type pump, the check valve prevents pressure built up by retracting vanes from escaping into the pressure region without it being possible for a pressure to be built up in the under-vane regions of the vanes that are to be extended. The check valve can be used as a replacement for or in addition to the switchable valve described.

According to another aspect development of the invention, moving parts for closing the fluid duct during the starting of the vane-type pump can be avoided in a simple manner if a temperature-dependent hydraulic resistance is arranged in the fluid duct, wherein the hydraulic resistance is greatest at low temperatures. The hydraulic resistance is preferably designed such that the maximum leakage losses occurring during operation in the under-vane region produce a pressure difference which is clearly below the minimum operating pressure of the pump device. This ensures that the restricted pressure in the under-vane region does not fall below the ambient pressure and is sufficient to extend the vanes. By virtue of the temperature dependence, the hydraulic resistance enables the under-vane region to be decoupled from the pressure region during the starting of the pump device and hence while the medium is still cold, with the result that the under-vane regions of the retracting and of the extending vanes are coupled. Another advantage of this embodiment is that the pressure in the under-vane regions is restricted, thus minimizing the contact pressure of the extending vanes against the cam contour. This reduces friction and wear on the vane-type pump. In the simplest case, the hydraulic resistance is a restrictor. The hydraulic resistance can be used as a replacement for or in addition to the switchable valve or the check valve.

A contribution to a further reduction in the structural complexity of the pump device is made if the pressure region is arranged at the outlet of the vane-type pump.

According to another advantageous aspect of to the invention, the vanes can be extended hydraulically in a reliable manner if the pressure region is arranged at the outlet of a second pump. By this embodiment, some of the delivery flow of the second pump can be used to hydraulically extend the vanes of the vane-type pump. By virtue of this embodiment, the pump device according to the invention has two pumps which can be operated independently of one another.

According to another advantageous aspect of the invention, the second pump allows direct production of a pressure for extending the vanes of the vane-type pump if the second pump is a ring gear pump or is configured as a gear pump. By virtue of the principle involved, such ring gear pumps or gear pumps have fixed teeth, ensuring immediate delivery when the second pump starts, even when the media are cold and viscous.

According to another advantageous aspect of the invention, envisaged pressures in the under-vane regions can be ensured if the under-vane regions are connected to one another by a groove arranged in a stator, and if the groove has a constriction between the under-vane regions of the extending vanes and the under-vane regions of the retracting vanes. The constriction also acts as a restrictor and slows a transfer of the medium from one under-vane region to the other under-vane region.

BRIEF DESCRIPTION OF THE DRAWINGS

The invention allows numerous embodiments. To further clarify the basic principle thereof, several such embodiments are shown in the drawings and described below. In the drawings.

DETAILED DESCRIPTION OF THE PRESENTLY PREFERRED EMBODIMENTS

Figure 1:
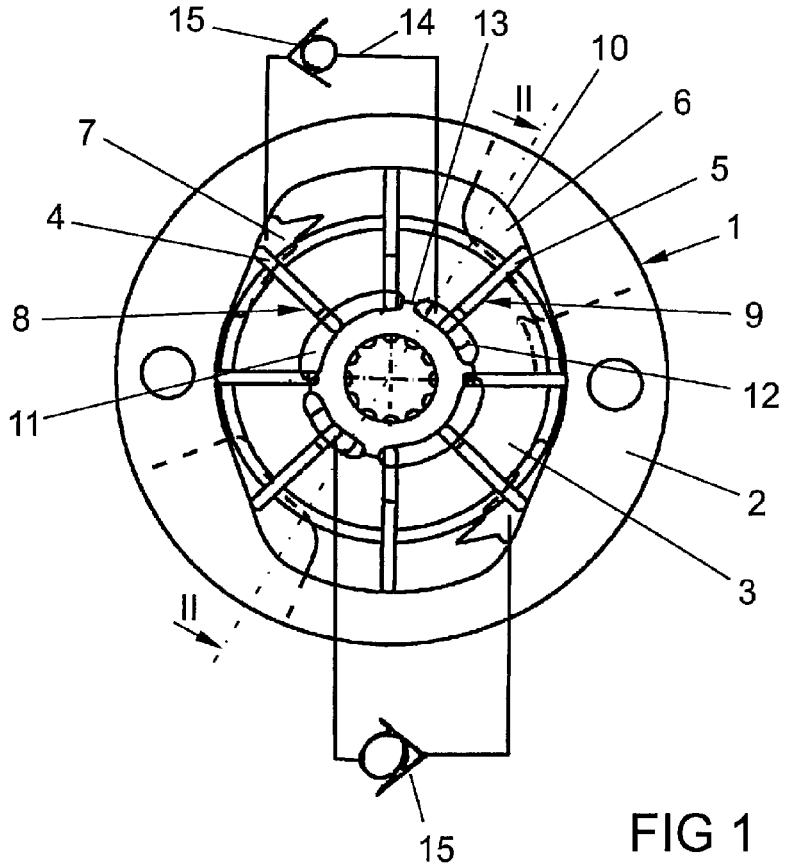
FIG. 1 shows a pump device according to an exemplary embodiment of the invention comprising a vane-type pump in a schematic view.

FIG. 1 shows a pump device having a double-lift vane-type pump 1. The vane-type pump 1 has a rotor 3, which can rotate in a stator 2, and extendable vanes 4, 5. The vane-type pump 1 delivers a medium, e.g. transmission oil, from suction regions 6 to pressure regions 7. The vanes 4, 5 are guided in a radially movable manner in vane slots 8, 9, against a cam contour 10 of the stator 2. The rotor 3 has under-vane regions 11, 12, which are partially connected to one another by constrictions 13. The pressure regions 7 are connected, via fluid ducts 14 with check valves 15 arranged therein, to under-vane regions 12 arranged in the suction region 6. The check valves 15 are aligned in such a way that they shut off in the direction of the pressure region 7. When the rotor 3 rotates counterclockwise, the vanes 4 situated in the pressure region 7 are pressed into the rotor 3, while vanes 5 situated in the suction region 6 are extended. The vanes 4 pressed into the rotor 3 build up a pressure in the under-vane regions 11, 12 which leads to the vanes 5 that are to be extended being extended out of the rotor 3. The check valves 15 prevent the pressure from escaping out of the under-vane regions 11, 12 during the starting of the vane-type pump 1, when pressure has not yet been built up in the pressure regions 7.

Figure 2:
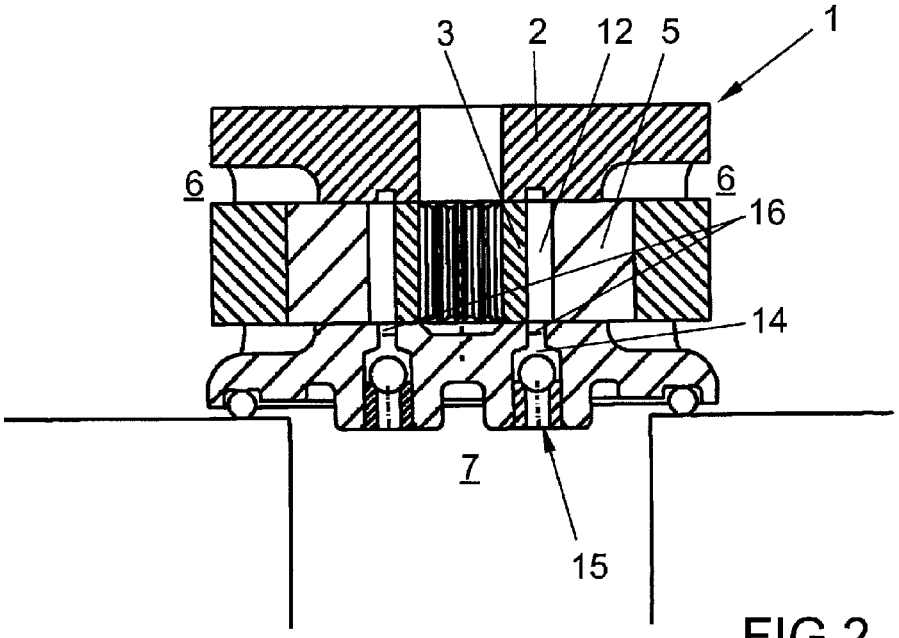
FIG. 2 shows a section through the vane-type pump from FIG. 1 along the line II-II.

FIG. 2 shows the vane-type pump 1 from FIG. 1 in a section along the line II-II. Here, it can be seen that the under-vane regions 11, 12 are connected to one another by a groove 16 arranged in the stator 2. The check valves 15 are likewise arranged in the stator 2. The constrictions 13 illustrated in FIG. 1, via which the under-vane regions 11, 12 are connected to one another, are arranged in the stator 2 and therefore fixed relative to the likewise fixed suction regions 6 and the pressure regions 7.

Figure 3:
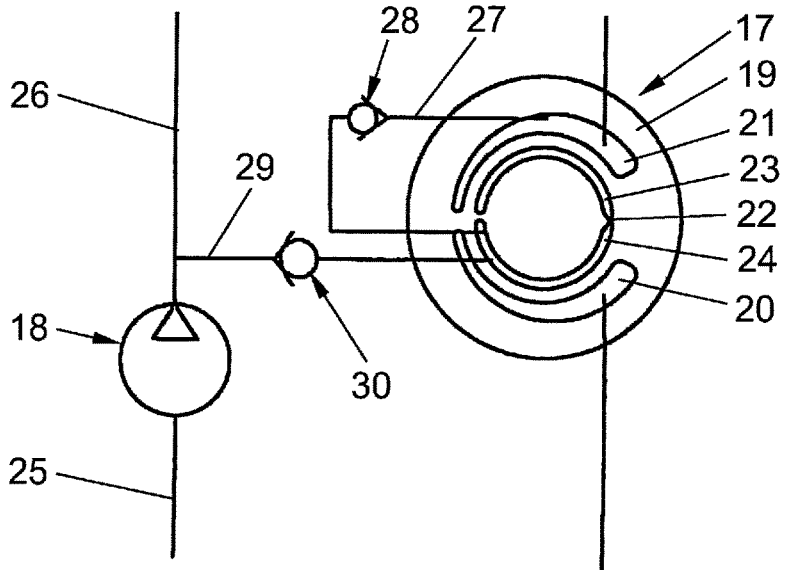
FIG. 3 shows another exemplary embodiment of the pump device according to the invention in a schematic view.

FIG. 3 shows another embodiment of the pump arrangement having a single-lift vane-type pump 17 and a second pump 18. For the sake of simplification, only the stator 19 of the vane-type pump 17 is shown, having suction regions 20, pressure regions 21 and under-vane regions 23, 24 connected to one another by a constriction 22. The second pump 18 is designed as a gear pump, for example, and delivers the medium from a suction region 25 to a pressure region 26. As in the embodiment according to FIGS. 1 and 2, the pressure region 21 of the vane-type pump 17 is connected to the under-vane region 24 in the suction region 20 by a fluid duct 27 having a check valve 28. The pressure region 26 of the second pump 18 is likewise connected to the under-vane region 24 by a second fluid duct 29 having a second check valve 30. The two check valves 28, 30 are configured such that a pressure cannot escape from the under-vane regions 23, 24. However, as soon as a pressure has been built up in the pressure regions 21, 26 of the vane-type pump 17 or the second pump 18, the delivered medium passes via the fluid ducts 27, 29 into the under-vane regions 23, 24.

Figure 4:
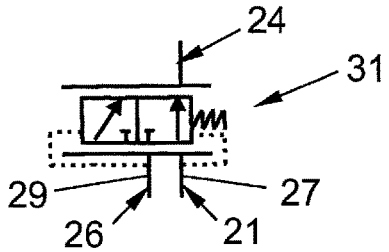
FIG. 4 shows a 3/2-way valve for the pump device from FIG. 3.

FIG. 4 shows a switchable 3/2-way valve 31, which can be used instead of the two check valves 28, 30 in the pump device from FIG. 3. As soon as the vane-type pump 17 or the second pump 18 builds up a pressure in the respective pressure region 21, 26, this pressure region 21, 26 is connected to the under-vane regions 24. It is thereby possible to connect the pressure region 26 of the second pump 18 to the under-vane region 24 of the vane-type pump 18 and, at the same time, to prevent the pressure from escaping into the pressure region 21 of the vane-type pump 17.

Figure 5:
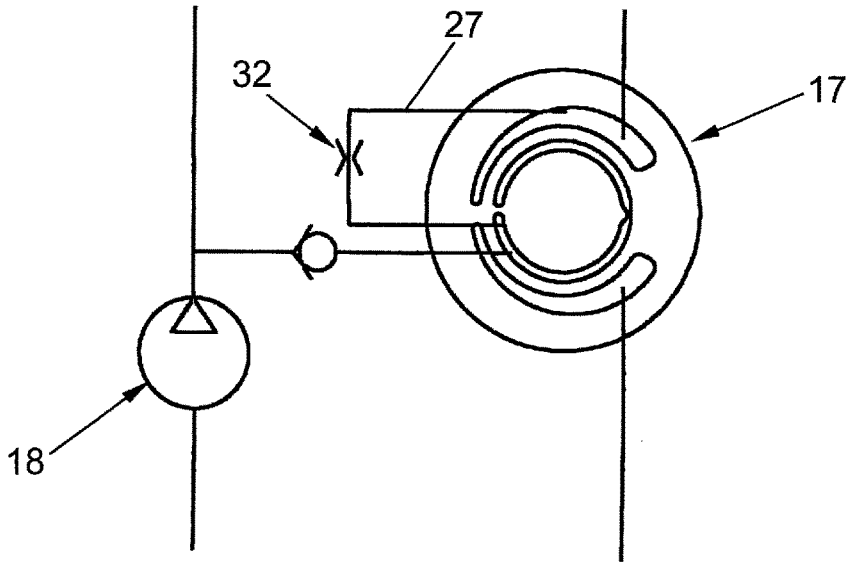
FIG. 5 shows another embodiment of the pump device according to the invention in a schematic view.

FIG. 5 shows another embodiment of the pump device, which differs from that in FIG. 3 especially in that the vane-type pump 17 has a temperature-dependent hydraulic resistance 32 instead of the check valve 28. The resistance 32 is greatest when the temperature is lowest. In other respects, the pump device is constructed as described in relation to FIG. 3.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A pump device for delivering a medium, the pump device comprising:

a pressure region (7, 21, 26);

a vane pump (1, 17), having:

a stator (2, 19) having a cam contour (10), and a rotor (3), rotatable in the stator (2, 19) and having vanes (4, 5) extendable radially outward out of vane slots (8, 9) in the direction of the cam contour (10) of the stator (2, 19), and under-vane regions (11, 12, 23, 24), connected to the pressure region (7, 21, 26) of the pump device by a fluid duct (14, 27, 29) such that the under-vane regions (11, 12, 23, 24) are subjected to pressure to hydraulically extend the vanes (4, 5), wherein the under-vane regions are connected to one another; and a temperature-dependent hydraulic resistance (32) arranged in the fluid duct (27, 29), wherein the resistance value of the temperature-dependent hydraulic resistance (32) is greatest at low temperatures, the hydraulic resistance being configured such that maximum leakage losses occurring during operation of the under-vane regions produce a pressure difference below a minimum operating pressure of the pump device, the temperature dependence of the hydraulic resistance being sufficient to enable the under-vane regions to be decoupled from the pressure region during a starting of the pump device, wherein the fluid duct (14, 27, 29) is closed from the under-vane regions (11, 12, 23, 24) in the direction of the pressure region (7, 21, 26) at least during the starting of the vane pump (1, 17).

2. The pump device as claimed in claim 1, further comprising a switchable valve (31) arranged in the fluid duct (27, 29).

3. The pump device as claimed in claim 1, further comprising a check valve (15, 28, 30) arranged in the fluid duct (14, 27, 29), the check valve (15, 28, 30) being configured to shut off in the direction of the pressure region (7, 21, 26).

4. The pump device as claimed in claim 1, wherein the pressure region (7, 21) is arranged at an outlet of the vane pump (1, 17).

5. The pump device as claimed in claim 1, further comprising a second pump (18), wherein the pressure region (26) is arranged at an outlet of the second pump (18).

6. The pump device as claimed in claim 5, wherein the second pump (18) is a ring gear pump or a gear pump.

7. The pump device as claimed in claim 1, further comprising a groove (16) arranged in the stator (2, 19), wherein the vanes (4, 5) comprise extending vanes (5) and retracting vanes (4), and wherein the under-vane regions (11, 12, 23, 24) are connected to one another by the groove (16), and the groove (16) has a constriction (13, 22) between under-vane regions (12, 24) of the extending vanes (5) and an under-vane region (11, 23) of the retracting vanes (4).

* * * * *